US006241181B1

(12) United States Patent
Campbell

(10) Patent No.: US 6,241,181 B1
(45) Date of Patent: Jun. 5, 2001

(54) REUSABLE WIRE DISTRIBUTION SPOOL

(76) Inventor: William F. Campbell, 4003 Charles St., Rockford, IL (US) 61108-6135

( * ) Notice: Subject to any disclaimer, the term of this patent is extended or adjusted under 35 U.S.C. 154(b) by 0 days.

(21) Appl. No.: 09/354,069

(22) Filed: Jul. 15, 1999

(51) Int. Cl.[7] ..... B65H 75/22; B65H 75/24
(52) U.S. Cl. ..... 242/578; 242/609; 242/609.3
(58) Field of Search ..... 242/578, 578.1, 242/578.2, 578.3, 609, 609.1, 609.2, 609.3, 118.4, 118.5, 118.61

(56) References Cited

U.S. PATENT DOCUMENTS

| | | | | |
|---|---|---|---|---|
| 875,476 | | 12/1907 | Wasson . | |
| 1,078,419 | | 11/1913 | Cronin . | |
| 1,660,521 | | 2/1928 | Nordgren . | |
| 1,684,037 | | 9/1928 | Leedy . | |
| 2,155,769 | | 4/1939 | Porter . | |
| 2,579,046 | | 12/1951 | Locke et al. . | |
| 2,705,114 | | 3/1955 | Worsham . | |
| 3,030,047 | * | 4/1962 | Anderson et al. | 242/609 |
| 3,104,851 | | 9/1963 | Portal . | |
| 3,521,833 | | 7/1970 | Ridgeway et al. . | |
| 3,661,341 | | 5/1972 | Eifrid . | |
| 3,704,838 | | 12/1972 | Bernier et al. . | |
| 3,826,444 | * | 7/1974 | Hahm | 242/578 |
| 4,068,808 | * | 1/1978 | King | 242/118.4 |
| 4,269,371 | | 5/1981 | Kovaleski . | |
| 4,391,422 | | 7/1983 | McDonald . | |
| 4,428,546 | * | 1/1984 | Weideman | 242/578.1 |
| 4,457,527 | | 7/1984 | Lowery . | |
| 4,530,472 | | 7/1985 | Voss et al. . | |
| 4,564,152 | | 1/1986 | Herriage . | |
| 4,605,237 | | 8/1986 | Torgrimson . | |
| 4,867,391 | * | 9/1989 | Resch | 242/578 |
| 4,901,937 | | 2/1990 | Mendoza . | |
| 4,997,142 | * | 3/1991 | Grant | 242/118.4 |
| 5,242,129 | | 9/1993 | Bailey et al. . | |
| 5,308,012 | | 5/1994 | Fuller . | |
| 5,464,171 | * | 11/1995 | Ripplinger | 242/609.1 |
| 5,509,671 | | 4/1996 | Campbell | 242/594.6 |
| 5,622,333 | * | 4/1997 | Jacques | 242/578.1 |
| 5,687,928 | | 11/1997 | Lassiter | 242/557 |
| 5,915,646 | | 6/1999 | Campbell | 242/594.4 |

* cited by examiner

*Primary Examiner*—John M. Jillions
(74) *Attorney, Agent, or Firm*—Marshall, O'Toole, Gerstein, Murray & Borun

(57) ABSTRACT

A reusable spool for use in installing electrical wiring is provided. The spool may include first and second mating halves, each having an end plate and a central mandrel. The mandrel of one half may be inserted into a wound coil of wire, which can then be overturned to allow the second half to be connected to the first half. The first and second halves may be joined through a plurality of arcuate longitudinal tabs which slidably engage in one position to adjust width, and upon rotation, lock frictionally into a given position.

13 Claims, 6 Drawing Sheets

REUSABLE WIRE DISTRIBUTION SPOOL

FIELD OF THE INVENTION

The present invention generally relates to equipment for installing electrical wiring into structures, and more particularly relates to spools for distributing electrical wiring.

BACKGROUND OF THE INVENTION

The process of installing electrical wiring into structures, for example new homes, is relatively time consuming, and can lead to frustrating entanglements or other shortcomings in the distribution of the wire. For example, electrical wiring is often provided from the manufacturer in the form of a wound coil, with a simple plastic wrapping therearound. The electrician installing the wire into the building or structure is required to remove the plastic wrapping and pull an end of the wire to begin installation. This can result in the coil itself being pulled with the wire such that it is not readily distributed. Many electricians therefore are required to produce or fabricate some sort of axle or mandrel about which the coil may rotate. This can be frustrating to the electrician, and necessarily results in slower installation times.

Alternatively, wire coils are sometimes provided within cardboard boxes. The cardboard boxes are typically provided with a scored area which must be removed such that the electrician can reach in and grab an end of the wire to begin the installation process. However, this can also be frustrating and slow in that the cardboard box will tend to be pulled with the wire.

It would be advantageous if the wire were to be provided on a spool adapted for rotation, but such spools are often not provided by the manufacturer for cost reasons. However, if the coils were provided on spools, they could be readily affixed to any axle for rotation such as those disclosed in my previous U.S. Pat. No. 5,509,671. Such a device has a plurality of racks on which the spools can be mounted for easy rotation and replacement once empty.

It would therefore be advantageous if a reusable spool were to be provided, which would allow manufacturers to continue to provide electrical coils either within the aforementioned plastic wrapping or cardboard box, and still enable the electrician to readily, and repeatedly, mount the coil for rotation.

SUMMARY OF THE INVENTION

In accordance with one aspect of the invention, a spool having first and second mating halves is provided. The spool may include an end plate, an inner cylinder extending from the end plate, and an outer cylinder extending from the end plate and concentric with the inner cylinder. The inner cylinder may have a plurality of longitudinally extending and circumferentially spaced recesses, with the outer cylinder also having a plurality of longitudinally extending and circumferentially spaced recesses, but with the recesses of the outer cylinder being radially offset from the recesses of the inner cylinder. The spool may also include a locking surface on the inner circumference of the outer cylinder and outer circumference of the inner cylinder, such that rotation of one half relative to the other is inhibited in one direction of rotation by engagement of the locking surfaces.

In accordance with another aspect of the invention, the inner and outer cylinders may include a plurality of circumferentially spaced segments between the recesses, with the locking surfaces increasing the thicknesses of the circumferentially spaced segments. The locking surfaces may extend along the entire length of the spaced segments such that the first and second halves can be locked together at a plurality of distances, and thus accommodate a variety of coil sizes.

In accordance with another aspect of the invention, the end plate, inner cylinder, outer cylinder and locking surfaces of each half may be integrally molded together. A central hub defining a bearing surface for rotation of the spool may also be integrally molded in the end plate.

In accordance with another aspect of the invention, a spool having first and second mating halves is provided, which may include an end plate, a first plurality of arcuate legs extending normal to the end plate, and a second plurality of arcuate legs extending normal to the end plate and being spaced in a circumferential array concentric with the first plurality of legs. The first plurality of legs may also be spaced in a circumferential array with the first and second plurality of legs being arranged in alternating sequence. At least one arcuate leg of each plurality of legs may include a first end of a first thickness and second end of a second thickness, with the second thickness being greater than the first thickness. The first and second halves may be rotatable in opposite directions relative to each other when the first ends are radially aligned, and be substantially prevented from rotation when the second ends are radially aligned.

In accordance with yet another aspect of the invention, a two-piece spool is provided which may include a first half, a second half, and a means for releasably connecting the first and second halves at a variable distance. Each half may include an end plate and a central mandrel.

In accordance with another aspect of the invention, a method for mounting a coil of an electrically conductive wire to a reusable spool is provided, which may comprise the steps of inserting a mandrel of a first half of a spool through a central opening in a coil, overturning the first half of the spool, engaging a mandrel of a second half of the spool with the mandrel of the first half, and releasably locking the first half to the second half.

These and other features and advantages of the present invention will become more apparent from the following detailed description when taken in conjunction with the accompanying drawings.

Figure 1:
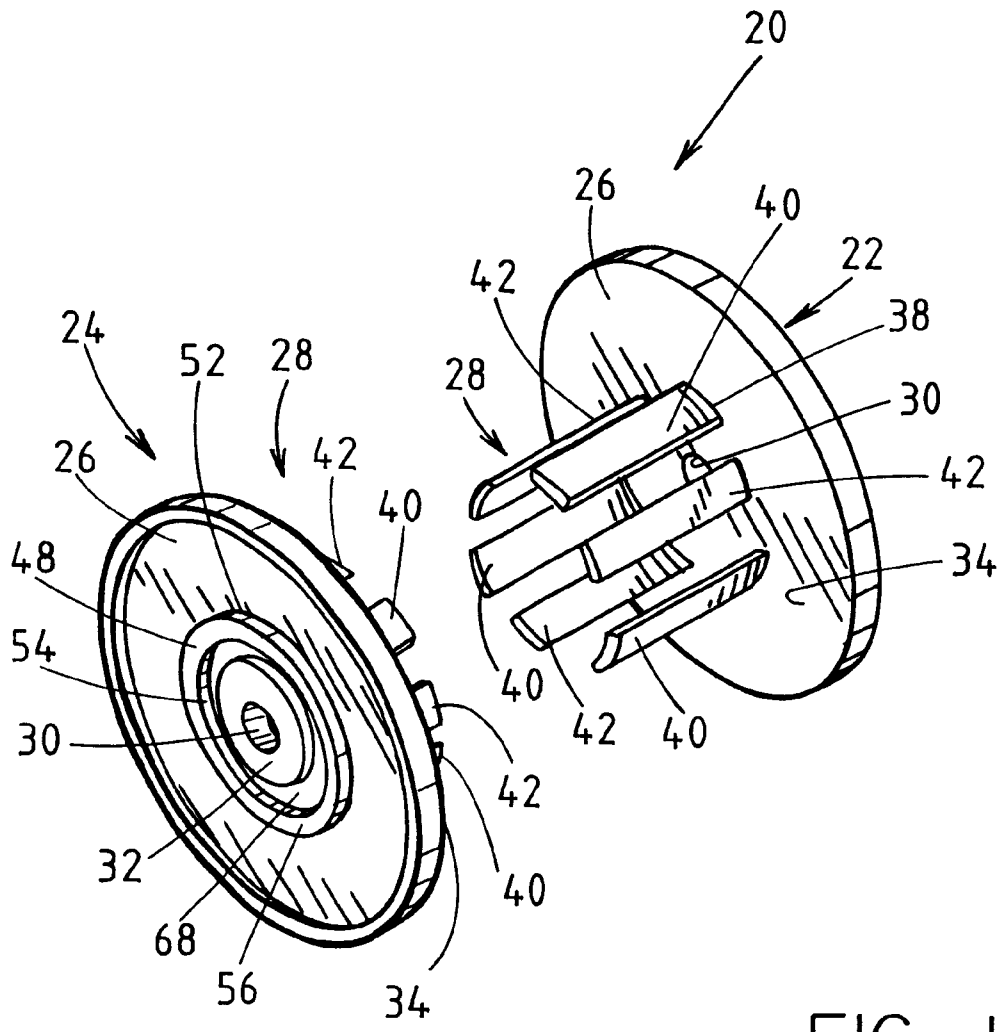
FIG. 1 is a perspective exploded view of a spool constructed in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the invention is to cover all modifications, alternative constructions and equivalents falling within the spirit and scope of the invention as defined by the appended claims.

DETAILED DESCRIPTION OF THE INVENTION

Referring now to the drawings, and with specific reference to FIG. 1, a reusable spool constructed in accordance with the present invention is generally depicted by reference numeral 20. As can be seen, the spool 20 may include a first half 22, as well as a second half 24, which are adapted to mate together. Each half 22 and 24 includes a substantially circular end plate 26 from which a central mandrel 28 extends in an orthogonal direction. It is about the mandrel 28 that a wire coil (not shown) may be positioned for installation. Each end plate 26 also includes a central hub 30 defined by an annular rim 32. One of ordinary skill in the art will readily recognize that the central hubs 30 can be utilized for mounting the spool 20 to a suitable axle for rotation.

While the depicted embodiment is constructed from integrally molded plastic such as foamed polystyrene, it is to be understood that spools built in accordance with the present invention can be manufactured from other materials including metal, and can be constructed from multiple components assembled together.

Figure 2:
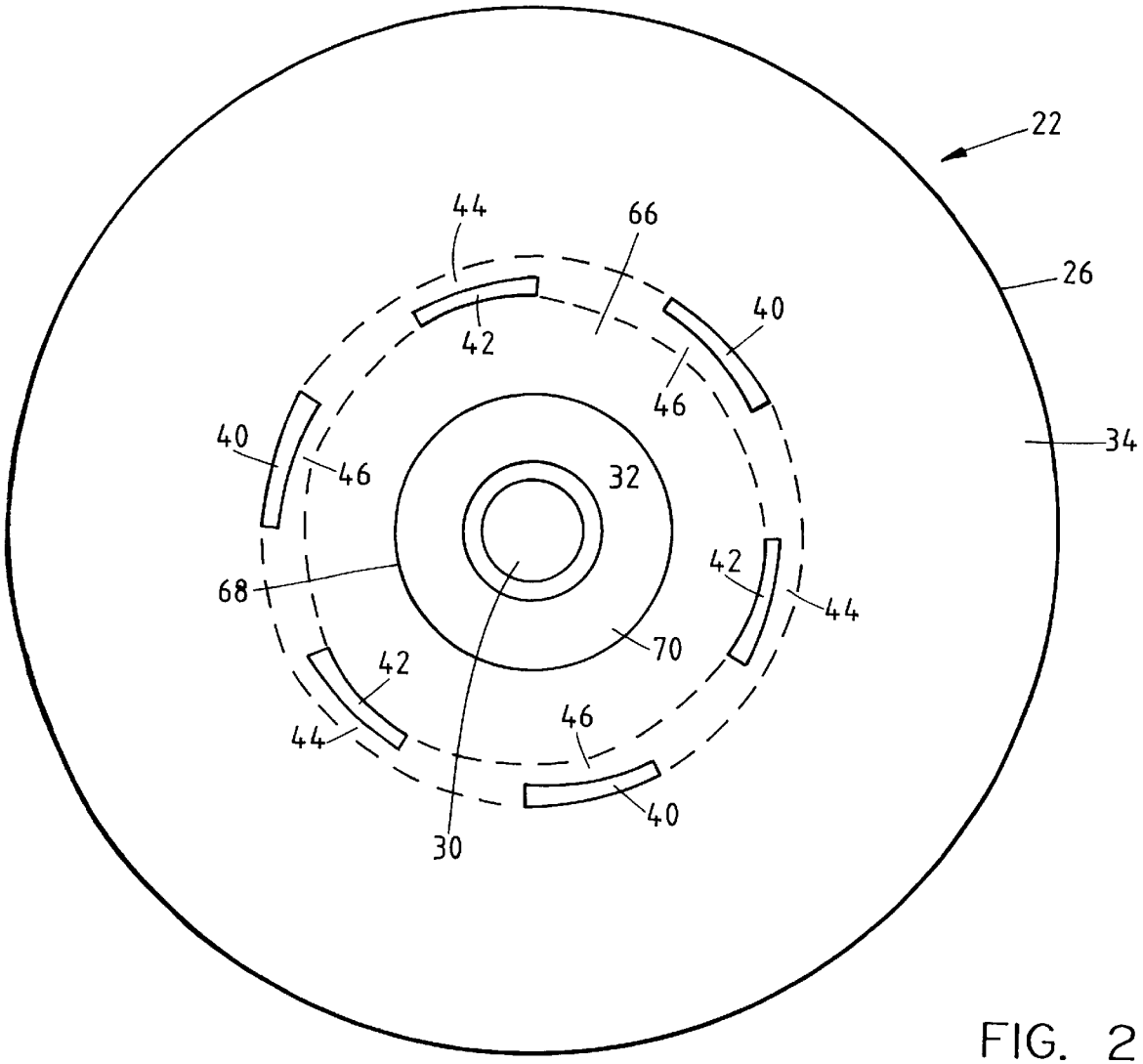
FIG. 2 is a plan view of one half of the spool.
Figure 3:
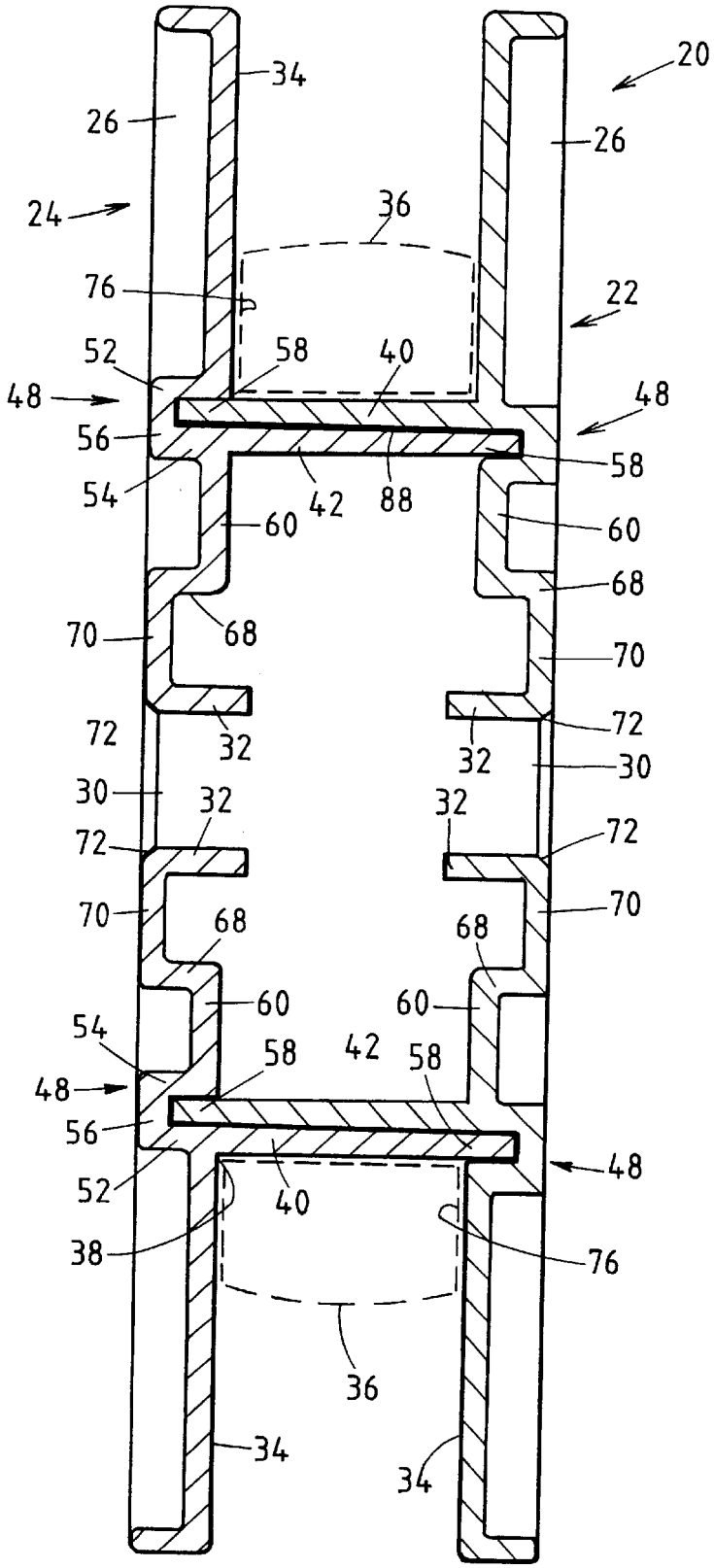
FIG. 3 is a sectional view of the coil in its most narrow configuration.
Figure 4:
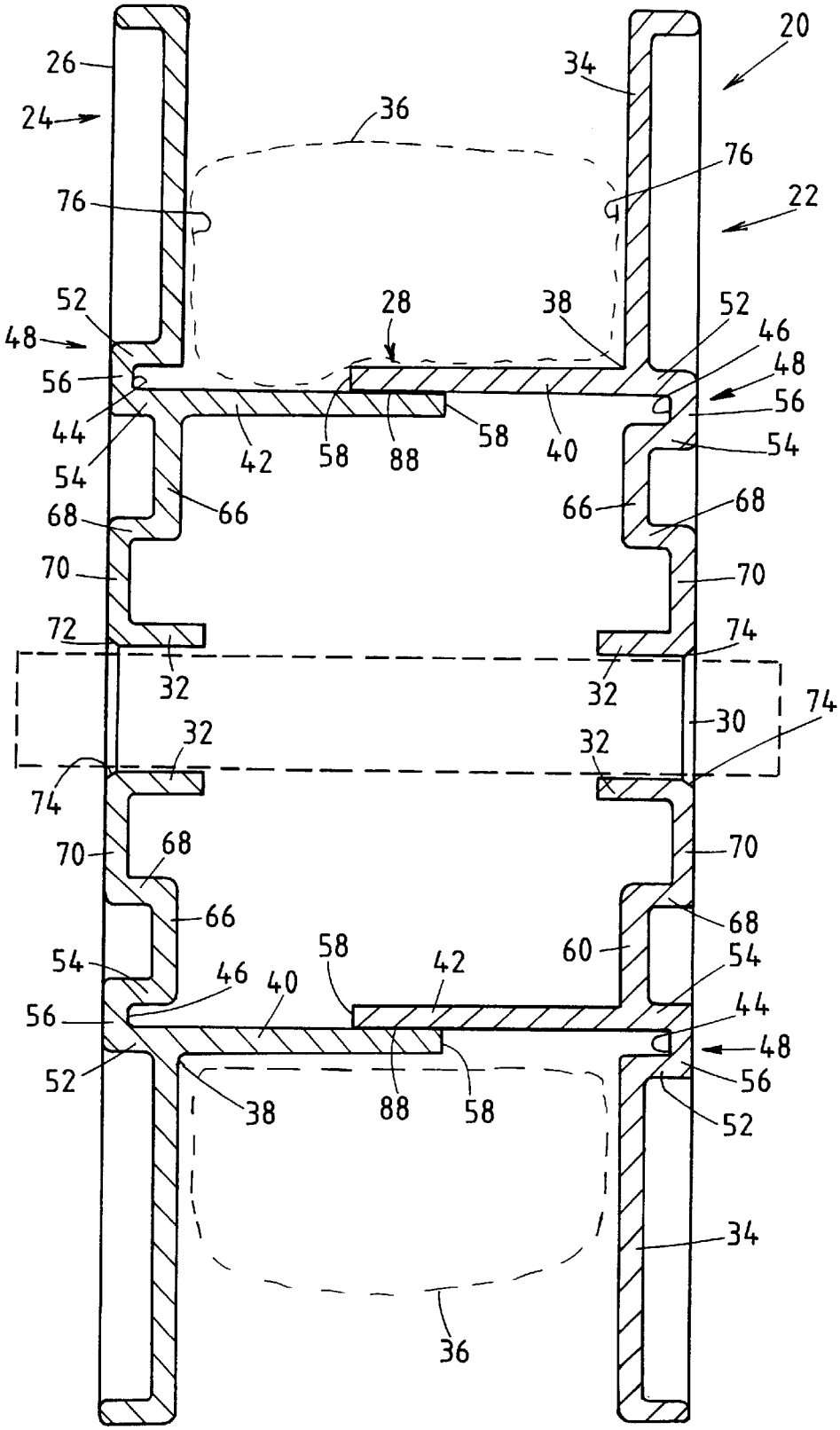
FIG. 4 is a sectional view of the spool in its widest configuration.

Referring now to FIGS. 2–4, it will be noted that the first and second halves 22 and 24 are identical in construction. Each end plate 26 includes an outer annular wall 34, which as shown in FIGS. 3 and 4 serve to retain the sides of a wire coil 36 thereon. At the inner circumference 38 of the outer annular wall portion 34, a plurality of longitudinal tabs, segments or legs 40 extend orthogonally to the plane of the outer annular wall 34. In the depicted embodiment shown in FIG. 2, it will be noted that three such tabs 40 are provided and are spaced approximately at 120 degrees from one another. However, such quantities and angles, are not necessary, and the present invention can be practiced with more or less tabs at different spacings. Radially inward of, and circumferentially offset from, the longitudinal tabs 40 are a plurality of inner longitudinal tabs 42. In the depicted embodiment, three such inner longitudinal tabs 42 are provided, again at a spacing of approximately 120 degrees. The shape and positioning of outer longitudinal tabs 40 and the inner longitudinal tabs 42 will be discussed in further detail herein in reference to the locking mechanism of the present invention.

With respect to both the longitudinal tabs 40 and the inner longitudinal tabs 42, it will be noted that each is separated by a plurality of arcuate recesses. More specifically, the outer longitudinal tabs 40 are separated by outer arcuate recesses 44, while the inner longitudinal tabs 42 are separated by inner arcuate recesses 46. As can best be seen from FIGS. 3 and 4, the outer arcuate recesses 44 and outer arcuate recesses 46 are formed by angled walls 48. Again, the preferred embodiment of the present invention produces the first and second halves 22 and 24 from integrally molded pieces of plastic, such that the angled walls 48 are formed therein. More specifically, angled walls 48 include an upper wall 52, a parallel lower wall 54, and a perpendicular side wall 56. As shown in FIG. 3, the side wall 56 forms a positive stop for a mating end 58 of a longitudinal tab 40.

As shown in FIGS. 3 and 4, radially inward from the inner longitudinal tabs 42 and the inner arcuate recesses 46, is an inner ledge 66 which is connected to an axially extending return 68, which in turn is connected to an outer ledge 70, connected to the central hub 30. As will be noted, the joint between the outer ledge 70 and central hub 30 is provided with a chamfer 72 to facilitate loading of spool 20 on to a suitable axle shown in dashed lines as an axle 74.

As referenced above, the spool 20 is adapted to be locked into position within a range of widths, with FIG. 3 depicting the narrowest configuration, and FIG. 4 depicting the widest. Since each half 22 and 24 is identical, the particular width can be selected by first rotating one of the aligned halves relative to the other, approximately 30 degrees in the depicted embodiment, such that the inner longitudinal tabs 42 of one half are radially aligned with the outer arcuate recesses 44 of the other half, and in turn, the outer longitudinal tabs 40 are aligned with the inner arcuate recesses 46. In such a position, the first half 22 and the second half 24 can be moved axially, i.e., along the axis defined by the axle 74, from the minimum width position of FIG. 3 through the maximum width configuration of FIG. 4. This accordingly facilitates use of the spool 20 with a variety of differently sized wire coils 36 with the first and second halves 22 and 24 simply being moved axially relative to each other to engage the sides 76 of the wire coil 36.

Figure 5:
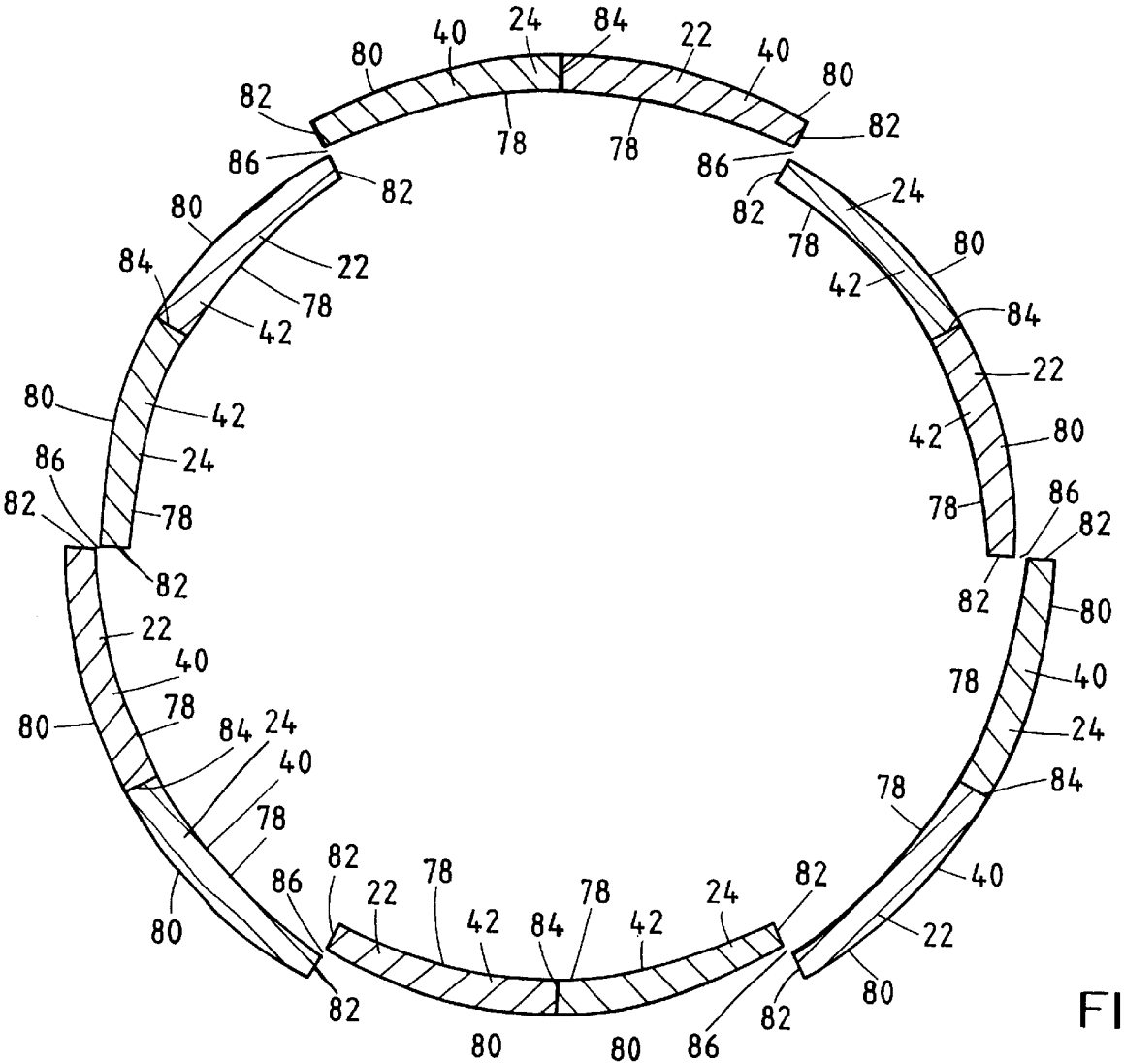
FIG. 5 is a sectional view of the longitudinal tabs of the spool in an unlocked position.
Figure 6:
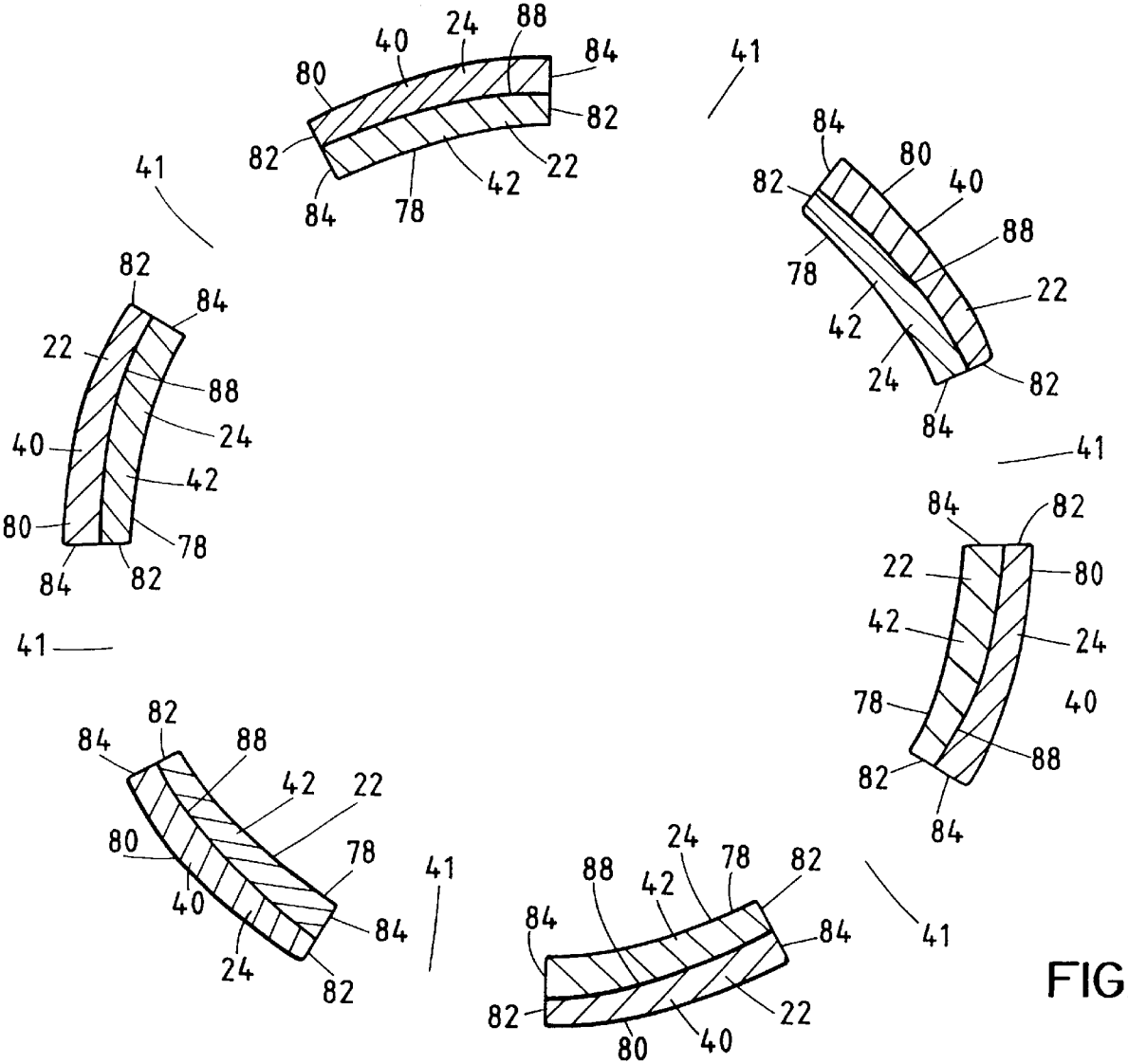
FIG. 6 is a sectional view similar to FIG. 5, but with the longitudinal tabs in a locked position.

Turning now with regard to the manner in which the first half 22 and second half 24 are locked together in a given configuration anywhere along the spectrum between FIG. 3 and FIG. 4, attention is directed to FIGS. 5 and 6. Each of the FIGS. 5 and 6 is a sectional view of only the longitudinal tabs 40 and 42 with FIG. 5 depicting the alignment for the unlocked position, and FIG. 6 depicting the locked position. The two halves 22 and 24 may be locked together using the inventive geometry of outer longitudinal tabs 40 and inner longitudinal tabs 42. As will be noted from the figures, each tab 40 and 42 is arcuate in cross-sectional shape, having an inner arcuate side 78, an outer arcuate side 80, a short end 82, and a long end 84. More specifically, it will be noted that each tab 40 and 42 tapers in width from the long end 84 to the short end 82.

Therefore, in the unlocked position shown in FIG. 5, each inner longitudinal tab 42 is aligned with an outer longitudinal tab proximate the short ends 82. In such a position, a gap 86 is provided between each outer longitudinal tab 40 and each inner longitudinal tab 42, such that they are not frictionally engaged. However, upon rotation, approximately 30 degrees in the preferred embodiment, the short ends 82 of each inner longitudinal tab 42 move in arcuate fashion toward the long end 84 of each outer longitudinal tab 40. Accordingly, each short end 82 of each outer longitudinal tab 40 is moved in an arcuate fashion in an opposite direction toward the long end 84 of each inner longitudinal tab 42. In so doing, the gap 86 progressively narrows until the inner arcuate side 78 of each inner longitudinal tab 42 frictionally engages the inner arcuate side 78 of each outer longitudinal tab 40. In the preferred embodiment, this frictional engagement occurs along the entire arcuate expanse 88 depicted in FIG. 6, and the frictional engagement locks the first half 22 to the second half 24. Moreover, in the locked position, it will be noted that the short ends 82 of each tab 40 and 42 are provided a distance 41, approximately 15 degrees in the depicted embodiment from the short end 82 of a neighboring tab 40 or 42. It will be noted that if sufficient torque is applied, inner and outer tabs will flex and the halves can rotate into distance 41. Distance 41 therefore allows for flexing and stress relief. The outer arcuate sides 80 of the outer longitudinal tab 40 provide the cylindrical surface or mandrel about which the wire coil 36 can be wound.

In operation, the present invention therefore provides a method by which the wire coil 36 can be mounted onto a reusable spool 20. More specifically, the first half 22 is inserted into the wire coil 36 such that the mandrel 28 of the first half 22 passes through a central opening (not shown) of the wire coil 36. The first half 22 and the wire coil 36 are then overturned, such that the wire coil 36 rests atop the end plate 26.

The second half 24 of the spool 20 is then inserted into the wire coil 36 in a similar fashion, but with the tabs 40 and 42 of the halves 22 and 24 aligned in the rotational position shown in FIG. 5. More specifically, the outer longitudinal tabs 40 of each half are inserted into the outer arcuate recesses 44 of the other half, and similarly, the inner longitudinal tabs 42 of each half are inserted into the inner arcuate recesses 46 of the other half. The tabs can be so inserted into the recesses to any desired width, but preferably to a width such that the outer annular walls 34 of each end plate 26 engage the sides of the wire coil 36.

Once the preferred depth or width of the spool 20 is reached, one half of the spool simply needs to be rotated relative to the other half to lock the halves 22 and 24 to one another. In so rotating, frictional engagement occurs between the outer arcuate sides 80 of the inner longitudinal tabs 42 with the inner arcuate side 78 of the outer longitudinal tabs 40 along arcuate expanses 88. After approximately 30 degrees of rotation in the preferred embodiment, the arcuate expanses 88 extend along the entire length of inner and outer arcuate sides 78, 80. In such a position, the halves 22, 24 are substantially locked together with distance 41 allowing for flexing and overrun.

From the foregoing, it can therefore be seen that the present invention provides a new and improved reusable spool for use in installing electrical wiring into buildings and other similar structures. Not only is the spool reusable in that it is provided in first and second mating halves, but it is adjusted to any width desired by the user and dictated by the size of the wire coil being installed. The user is therefore provided with a readily rotatable spool of wire which can be mounted to any suitable axle, including those provided in the carts of my previous patents, to facilitate installation of the wire.

What is claimed is:

1. A spool having first and second mating halves, each half comprising:

an end plate;

an inner cylinder extending from the end plate, the inner cylinder having a plurality of longitudinally extending, and circumferentially spaced recesses;

an outer cylinder extending from the end plate and concentric with the inner cylinder, the outer cylinder having a plurality of longitudinally extending and circumferentially spaced recesses, the recesses of the outer cylinder being radially offset from the recesses of the inner cylinder; and locking surfaces on the inner circumference of the outer cylinder and outer circumference of the inner cylinder, rotation of one of the first and second halves relative to each other being inhibited in one direction of rotation by engagement of the locking surfaces.

2. The spool of claim 1 wherein the inner and outer cylinders include a plurality of circumferentially spaced segments between the recesses, and wherein the locking surfaces increase the thicknesses of circumferentially spaced segments.

3. The spool of claim 2 wherein the locking surfaces extend along the entire length of the spaced segments such that the first and second halves can be locked together at a plurality of distances.

4. The spool of claim 1 wherein the end plate, inner cylinder, outer cylinder and locking surfaces of each half are integrally molded together.

5. The spool of claim 1 wherein each half includes a central hub defining a bearing surface for the spool.

6. The spool of claim 5 wherein the central hub is integrally molded to the end plate.

7. The spool of claim 1 wherein each end plate further includes a central hub, the central hubs defining a bearing surface about which the spool is adapted to rotate.

8. The spool of claim 1 wherein the first and second pluralities of legs are engageable along substantially their entire lengths, the width of the spool thereby being adjustable.

9. A spool having first and second mating halves, each half comprising:

an end plate;

a first plurality of arcuate legs extending normal to the end plate, the plurality of arcuate legs being spaced in a circumferential array; and a second plurality of arcuate legs extending normal to the end plate, the second plurality of arcuate legs being spaced in a circumferential array concentric with the first plurality of legs, the first and second pluralities of legs being arranged in alternating sequence;

at least one arcuate leg of each plurality of legs including a first end of a first thickness and a second end of a second thickness, the second thickness being greater than the first thickness, the first and second halves being rotatable relative to each other when the first plurality of legs and second plurality of legs are not radially aligned, the first and second halves being frictionally held together when the first plurality of legs and second plurality of legs are radially aligned.

10. The spool of claim 9 wherein the end plate and first and second pluralities of legs are integrally molded together.

11. A method of mounting a coil of conductive wire to a reusable spool comprising the steps of:

inserting a mandrel of a first half of a spool through a central opening in the coil;

overturning the first half of the spool such that the coil rests on an end plate of the first half about the mandrel;

engaging a mandrel of a second half of the spool with the mandrel of the first half, the engaging step including the steps of inserting longitudinal tabs of the first half into longitudinal slots in the second half, and inserting longitudinal tabs of the second half into longitudinal recesses in the first half; and releasably locking the first half to the second half, the releasably locking step including the step of rotating the second half relative to the first half to frictionally engage the longitudinal tabs of the first half with the longitudinal tabs of the second half.

12. The method of claim 11 wherein the longitudinal tabs of each half are circumferentially spaced and radially separated to define first and second radially spaced, concentric cyclinders.

13. The method of claim 11 wherein the spool is reusable by performing the step of unlocking the first and second halves and repeating the inserting, overturning, engaging, and locking steps.

* * * * *